US007537175B2

(12) United States Patent
Miura et al.

(10) Patent No.: US 7,537,175 B2
(45) Date of Patent: May 26, 2009

(54) SHOWERHEAD

(75) Inventors: Shoji Miura, Fukuoka (JP); Masato Yamahigashi, Fukuoka (JP)

(73) Assignee: Toto Ltd. (JP)

( * ) Notice: Subject to any disclaimer, the term of this patent is extended or adjusted under 35 U.S.C. 154(b) by 78 days.

(21) Appl. No.: 11/277,192

(22) Filed: Mar. 22, 2006

(65) Prior Publication Data

US 2006/0151640 A1 Jul. 13, 2006

Related U.S. Application Data

(63) Continuation of application No. PCT/JP2005/017793, filed on Sep. 28, 2005.

(30) Foreign Application Priority Data

Sep. 29, 2004 (JP) ..... 2004-285334

(51) Int. Cl.
*A62C 31/02* (2006.01)
*B05B 1/00* (2006.01)

(52) U.S. Cl. ..... 239/589; 239/590.3; 239/596

(58) Field of Classification Search ..... 239/589, 239/596, 266, 390, 391, 392, 436, 555, 533.14, 239/590.3, 525, 526
See application file for complete search history.

(56) References Cited

U.S. PATENT DOCUMENTS 3,547,352 A * 12/1970 Hadsel ..... 239/383
3,958,756 A * 5/1976 Trenary et al. ..... 239/381
4,588,130 A * 5/1986 Trenary et al. ..... 239/381
4,629,125 A * 12/1986 Liu ..... 239/443
5,918,811 A * 7/1999 Denham et al. ..... 239/123
6,612,507 B1 * 9/2003 Meyer et al. ..... 239/394

* cited by examiner

*Primary Examiner*—Davis Hwu
(74) *Attorney, Agent, or Firm*—Brooks Kushman P.C.

(57) ABSTRACT

Disclosed is a showerhead (1) capable of preventing damages in major or peripheral components and water leakage even if it is increased in size. The showerhead comprises a lower plate (2) formed with a plurality of discharging holes (2*c*) for discharging shower water therethrough, an upper plate (4) connected to the lower plate and formed with a water inlet port (4*c*), and a channel-defining member (6) disposed between the lower and upper plates to define an effective channel (6*c*, 6*d*) for allowing hot water entered between the lower and upper plates from the water inlet port to be led to each of the discharging holes, and an ineffective channel, so as to reduce a pressure-receiving area of the lower or upper plate to be subjected to a water pressure.

12 Claims, 13 Drawing Sheets

SHOWERHEAD

CROSS-REFERENCE TO RELATED APPLICATIONS

This is a continuation of PCT International Application No. PCT/JP2005/017793, published in Japanese, with an international filing date of Sep. 28, 2005, which claims priority to JP 2004-285334, filed Sep. 29, 2004, which is hereby incorporated by reference in its entirety.

TECHNICAL FIELD

The present invention relates to a showerhead for use as equipment in a bathroom or a shower room.

BACKGROUND ART

Heretofore, there has been known a showerhead designed to be mounted to a ceiling or an upper portion of a wall surface of a bathroom or a shower room. The showerhead is provided with a shower plate made of metal or a resin material with high rigidity, and attached to a pipe installed to protrude from a wall surface, so as to discharge shower water from above the head of a user. In this type of conventional showerhead, the shower plate is simply connected to a showerhead body having a water inlet port. Further, the shower plate is convexedly curved in an approximately bowl shape, and formed with a plurality of discharging holes arranged, respectively, along a plurality of lines extending radially from the center of a sphere defined by a curved surface of the shower plate, so as to discharge water therefrom at a spray diameter greater than a diameter of the shower plate (see, for example, the following Patent Publication 1 and FIG. 4).

Late years, in connection with consumer' preferences for obtaining refreshing feel during bathing without getting into a bathtub or differentiating an interior design of a bathroom or a shower room, there is a growing need for increasing the size of a showerhead to the extent that the body of a user can be entirely wrapped with a large volume of shower water discharged therefrom. U.S. Pat. No. 6,382,531 (Patent Publication 2) discloses such a large-sized showerhead.

Patent Publication 1: Japanese Utility Model Laid-Open Publication No. 4-114450 Patent Publication 2: U.S. Pat. No. 6,382,531

DISCLOSURE OF THE INVENTION

However, it is difficult to dimensionally increase the aforementioned conventional showerhead without structural modification so as to obtain a practicable large-size showerhead having a convexedly-curved-shaped shower plate simply increased in diameter. Specifically, if the conventional showerhead is simply increased in dimension, an area to be subjected to a water pressure will be inevitably increased in the inside of the showerhead. For example, the shower plate will be pressed by an extremely large force due to the water pressure. In consequence, components of the showerhead, such as the shower plate, are deformed to deteriorate watertightness in an internal region of the showerhead watertightly sealed using a packing, an O-ring, etc. This is likely to cause a problem about water leakage. Further, the deformation in the components of the showerhead is likely to damage a connection between the showerhead body and the shower plate or a connection of the shower head and the pipe to cause a problem about dropping-off of the spray pipe or the showerhead Moreover, if the conventional showerhead is simply increased in dimension, a void space in the showerhead will be inevitably increased, and a large volume of water will undesirably remain in the void space as residual water when the shower water is stopped. Further, as mentioned above, the discharging holes formed in the shower plate are arranged, respectively, along a plurality of lines extending radially from the center of a sphere defined by the curved surface of the shower plate. Therefore, due to gravity, the residual water around the discharging holes has a region where a number density of water molecules is reduced to have relatively strong surface tension, and a region where a number density of water molecules is increased to have relatively weak surface tension. That is, the surface tension becomes uneven at the respective splay holes. In the result, the surface tension at some of the discharging holes becomes unable to withstand atmospheric pressure, and outside air flows into the showerhead through these discharging holes. The inflow air presses the residual water in the showerhead to cause a problem about continuous water dripping from a part of the discharging holes.

Furthermore, if the showerhead formed with the discharging holes arranged, respectively, along a plurality of lines extending radially from the center of a sphere defined by the curved surface of the shower plate is attached at a position having a low water pressure, a plurality of stream lines of water discharged from the showerhead will come into contact with each other to cause a problem about ugly appearance in streamlines. The ugly streamlines will spoil the intended purpose of improving comfort and the grade as an ornamental article of the large-size showerhead, resulting in decline in value thereof.

It is therefore an object of the present invention to provide a showerhead capable of suppressing water dripping after stop of water discharge.

It is another object of the present invention to provide a showerhead capable of discharging water in aesthetic streamlines even when a water pressure is low.

In order to achieve the above object, the present invention provides a showerhead comprising a lower plate formed with a plurality of discharging holes for discharging shower water therethrough, an upper plate connected to the lower plate and formed with a water inlet port, and a channel-defining member disposed between the lower and upper plates to define an effective channel for allowing hot water entered between the lower and upper plates from the water inlet port to be led to each of the discharging holes, and an ineffective channel, so as to reduce a pressure-receiving area of the lower or upper plate to be subjected to a water pressure.

In the showerhead of the present invention, hot water fed through the water inlet port formed in the upper plate is entered into the effective channel formed between the upper and lower plates, and then discharged from the discharging holes formed in the lower plate.

According to the showerhead of the present invention; hot water entered between the upper and lower plates flows through the effective channel without flowing in the ineffective channel, so that no water pressure is applied to a region of the upper or lower plate corresponding to the ineffective channel. This makes it possible to reduce a force caused by a water pressure to be applied to the upper or lower plate. Thus, even if a showerhead is increased in size, the risk of damages in the above components or peripheral components and water leakage can be avoided. Further, according to the showerhead of the present invention, hot water remains only in the effective channel. This makes it possible to reduce a volume of residual water and suppress water dripping after stop of water discharge.

In the showerhead of the present invention, the lower plate and the upper plate may have mutually opposed surfaces at least partly formed to be approximately flat and parallel to one another. The lower plate and the upper plate may also be joined together along their outer peripheral regions while sandwiching the channel-defining member between the approximately flat and parallel regions thereof Further, the channel-defining member may be disposed in contact with the lower plate or the upper plate, and form with a channel wall defining the effective channel in cooperation with the lower plate or the upper plate. The channel wall may be formed to have a height which increases in a direction from the periphery to the center of the channel-defining member.

In the showerhead having this feature, the channel wall formed in the channel-defining member is sandwiched between the lower and upper plates formed to be approximately flat and parallel to one another, and the lower and upper plates are joined together along their outer peripheral regions. The channel wall is formed to have a height which increases in a direction from the periphery to the center of the channel-defining member. Thus, a contact force between the channel wall and the lower or upper plate becomes higher in the central region and becomes lower in the outer peripheral region.

According to the showerhead having this feature, even if the lower or upper plate does not have complete flatness, the lower or upper plate can be reliably brought into contact with the channel wall only by joining the respective outer peripheral regions of the lower and upper plates together.

The present invention further provides a showerhead which is provided with a shower plate formed with a plurality of discharging holes for discharging shower water therethrough and a showerhead body connected to the shower plate and formed with a water inlet port, and designed to allow hot water entered from the water inlet port to be discharged through the discharging holes. The showerhead comprises a channel wall disposed between the shower plate and the showerhead body to define an effective channel and an ineffective channel isolated from the effective channel, the effective channel leading hot water fed from the water inlet port to each of the discharging holes, and a watertight member disposed between the shower plate and the showerhead body and in watertight contact with the channel wall so as to define the effective channel in cooperation with the channel wall.

In the showerhead of the present invention, the effective channel and the ineffective channel isolated from the effective channel are defined between the shower plate and the showerhead body in the cooperation between the channel wall and the watertight member. Among them, no water pressure is applied to the ineffective channel. This makes it possible to reduce a force caused by a water pressure in the inside of the showerhead, which is a major factor causing, damages and water leakage in the shower head.

In the showerhead of the present invention, the watertight member may includes a watertight portion disposed between the showerhead body and the shower plate to water-tightly seal the contact region with the channel wall, and a plurality of discharging nozzles formed on the watertight portion to protrude, respectively, from the discharging holes so as to discharge shower water therethrough.

In the showerhead having, this feature, the watertight member includes the discharging nozzles each having a nozzle hole for discharging shower water therethrough. Thus, even if the nozzle hole is clogged due to a foreign substance, such as calcium components contained in water, the foreign substance can be readily removed, for example, by repeatedly compressing the discharging nozzle with fingers.

The showerhead of the present invention may be designed to be mounted to a ceiling or a wall surface of a bathroom in such a manner that the shower plate is positioned approximately parallel to a floor surface, and the discharging holes or discharging nozzles are positioned approximately perpendicular to the floor surface.

In the showerhead having this feature, the shower plate is positioned approximately parallel to a floor surface of a bathroom or shower room, and the discharging holes or discharging nozzles are positioned approximately perpendicular to the floor surface, so that surface tension of residual water in the shower head becomes even to block inflow of outside air to the showerhead. This makes it possible to suppress water dripping or continuous dripping of residual water from a part of the discharging holes which would otherwise be caused by outside air flowing into the showerhead. In addition, during showering, shower water is discharged from the showerhead in a direction perpendicular to the floor surface. Thus, even when a water pressure is low, an aesthetic form of shower water can be maintained without contact between shower streamlines. This makes it possible to maintain grade of the showerhead both during discharge of shower water and during stop of shower water.

In the showerhead of the present invention, the shower plate may be formed in an approximately flat shape.

According to the showerhead having the shower plate formed in an approximately flat shape, a pressure-receiving area of the shower plate can be reduced as compared with the shower plate convexedly curved in an approximately cup shape. In addition, as compared with the shower plate convexedly curved in an approximately cup shape, an internal void space of the showerhead on the side of a back surface of the shower plate can be drastically reduced to reduce a volume of water remaining in the void space during stop of shower water. This makes it possible to further reliably suppress water dripping.

The showerhead of the present invention may further include a plurality of fasteners for fastening the shower plate and the showerhead body together. In this case, the shower plate may have a back surface formed with a plurality of fastener-receiving portions arranged at given intervals to receive therein the corresponding fasteners, and each of the fasteners may be engaged with a corresponding one of the fastener-receiving portions while penetrating the showerhead body, so as to fasten the shower plate and the showerhead body together.

In the showerhead having this feature, the watertight member is sandwiched between the shower plate and the showerhead body by a fastening force between the fastener-receiving portions on the back surface of the shower plate and the corresponding fasteners. This makes it possible to equalize a watertight contact force between the channel wall and the watertight member so as to further water-tightly define the effective channel and the ineffective channel.

As mentioned above, the showerhead of the present invention makes it possible to prevent damages in major and peripheral components and water leakage even if it is increased in size.

Further, the showerhead of the present invention makes it possible to suppress water dripping after stop of water discharge.

Furthermore, the showerhead of the present invention makes it possible to discharge water in aesthetic streamlines even when a water pressure is low.

BEST MODE FOR CARRYING OUT THE INVENTION

With reference to the accompanying drawings, a showerhead according to an embodiment of the present invention will now be described.

Figure 1:
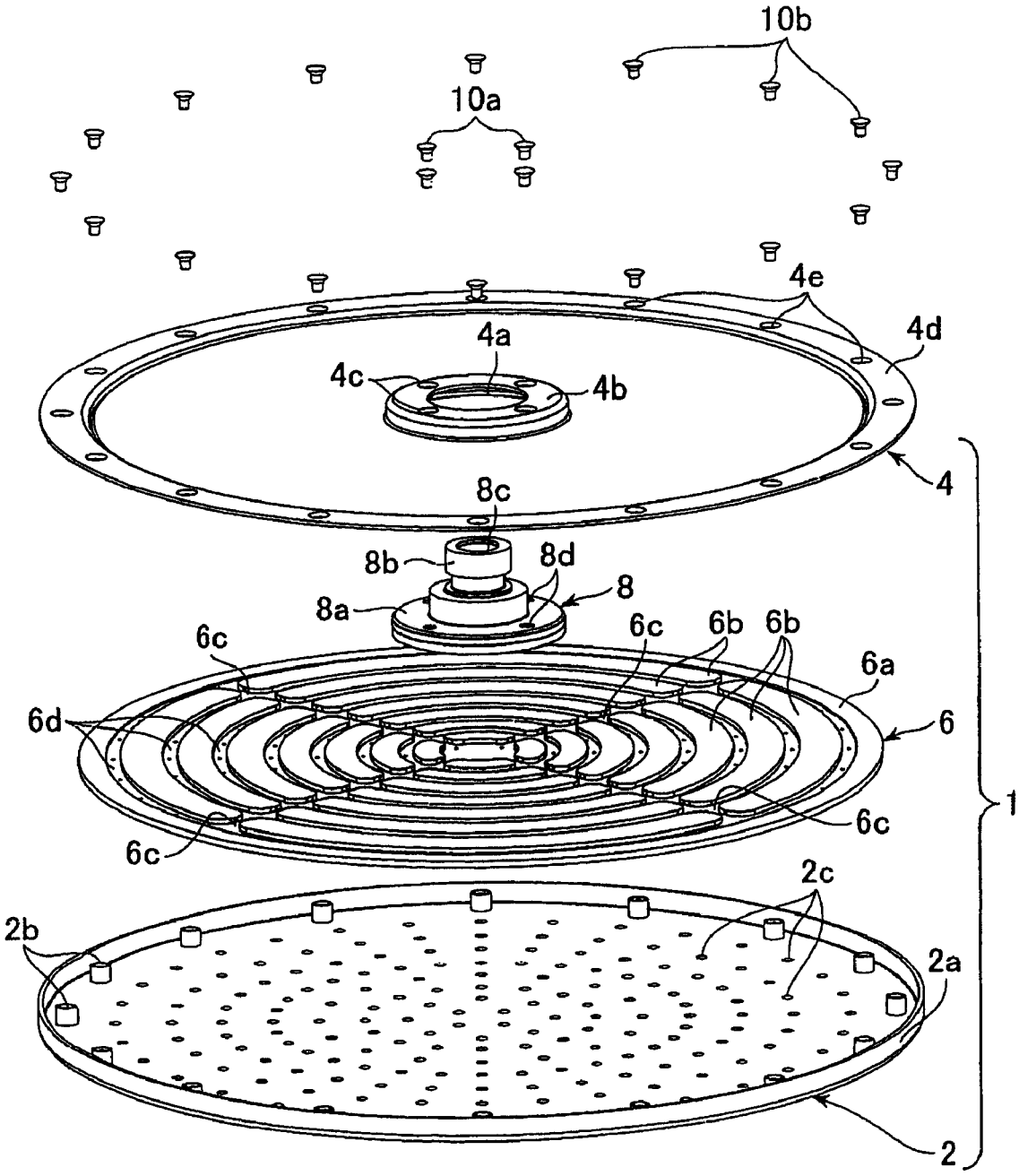
FIG. 1 is an exploded perspective view showing a showerhead according to a first embodiment of the present invention.
Figure 2:
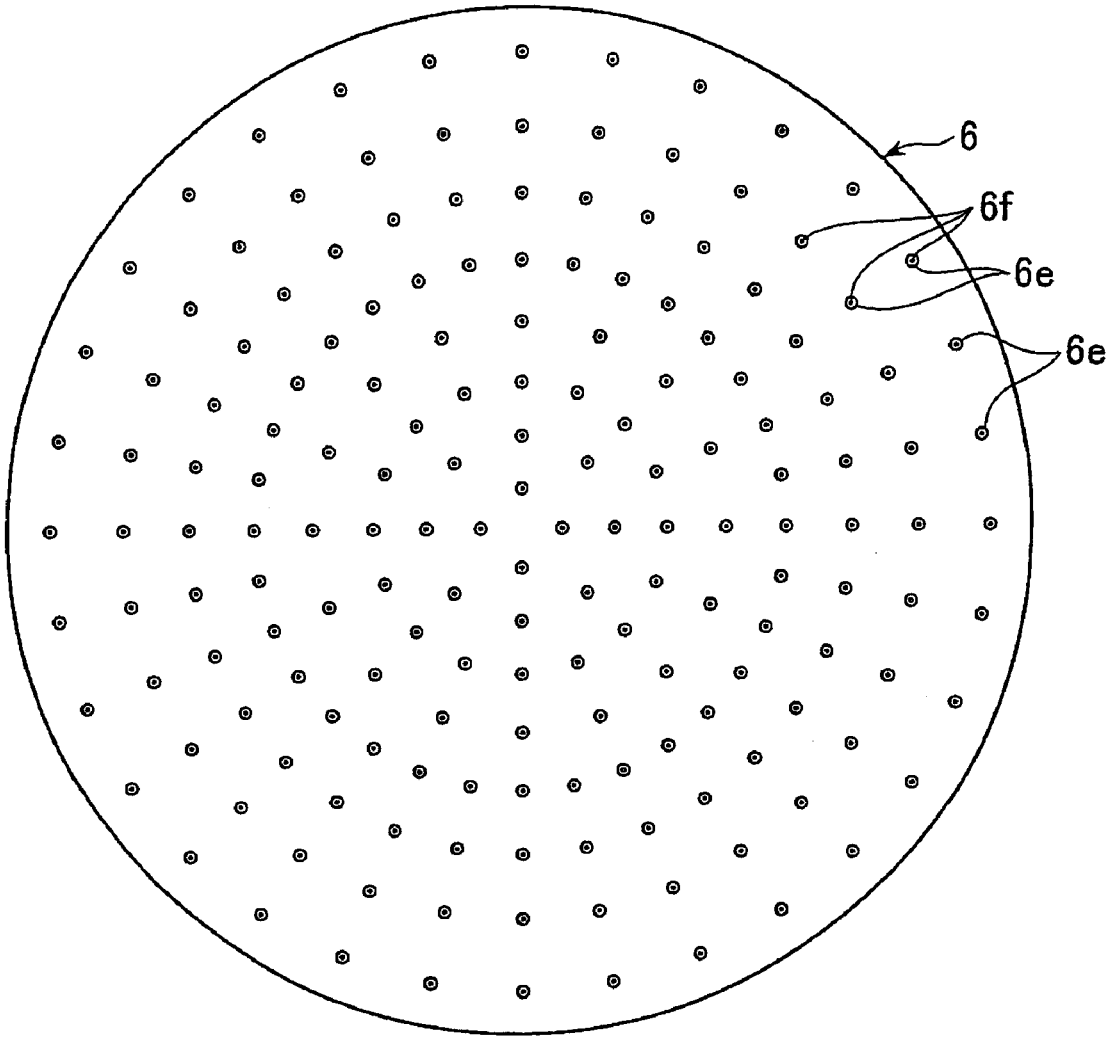
FIG. 2 is a bottom view showing a channel-defining member disposed in the showerhead according to the first embodiment.
Figure 3:
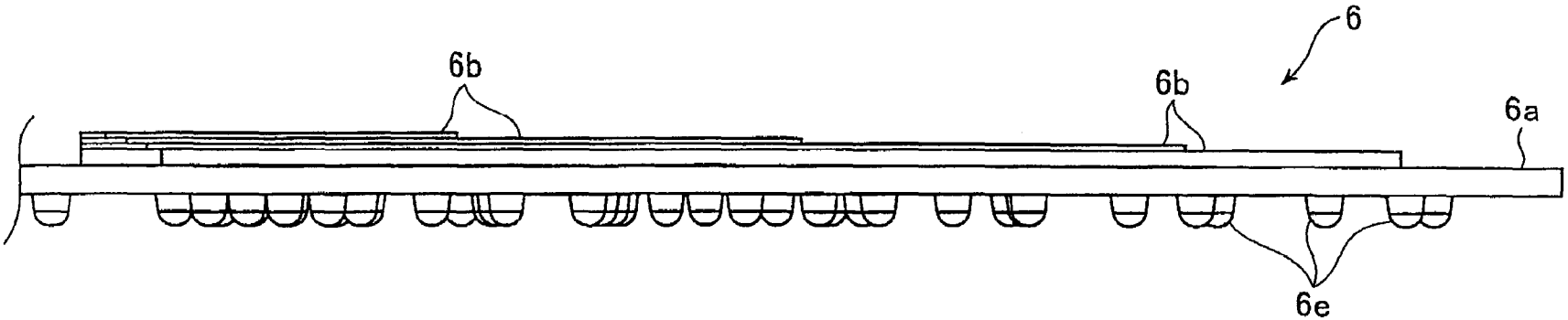
FIG. 3 is a side view showing the channel-defining member in the showerhead according to the first embodiment.

Firstly, with reference to FIGS. 1 to 3, a showerhead according to a first embodiment of the present invention will be described below. FIG. 1 is an exploded perspective view showing the showerhead according to this embodiment. FIG. 2 is a bottom view showing a channel-defining member disposed in the showerhead according to this embodiment, and FIG. 3 is a side view showing the channel-defining member.

As shown in FIG. 1, the showerhead 1 according to the first embodiment comprises an approximately circular-shaped lower plate 2 serving as a shower plate, an approximately circular-shaped upper plate 4 disposed above the lower plate 2, and an approximately circular disc-shaped channel-defining member 6 disposed between the lower plate 2 and the upper plate 4. The showerhead 1 further includes a joint 8 disposed to extend vertically while penetrating through the upper plate. The showerhead 1 according to this embodiment is intended to allow hot water fed from a pipe (not shown in FIG. 1) connected to the joint 8 to be dispersed through an effective channel defined by the channel-defining member 6 and then discharged from a plurality of discharging holes formed in the lower plate 2. In this embodiment, the showerhead 1 is designed to have a diameter of about 36 cm and discharge about 20 liters/minutes of hot water at a water pressure of about 0.2 MPa. Preferably, a diameter of the shower head is set in the range of about 20 to 40 cm while appropriately adjusting depending, for example, on water pressure, valve, piping and/or mounting position.

The lower plate 2 is formed of a circular disc-shaped metal thin plate. The lower plate 2 has an outer peripheral region bent upward at an approximately right angle to form a rim 2*a*. The outer peripheral region of the lower plate 2 is also formed with sixteen internally-threaded portions 2*b* arranged along a circumferential direction at even intervals to serve as a plurality of fastener-receiving portions. Each of the internally-threaded portions 2*b* has an approximately columnar shape having an internally-threaded hole ex-tending vertically along an axis thereof Further, the lower plate 2 has a number of discharging holes 2*c* formed therein in a concentric arrangement.

The upper plate 4 is formed of a circular disc-shaped metal thin plate. The upper plate 4 is subjected to a press forming process to generally have convex central and outer peripheral regions, and a doughnut-shaped concave flat region located between the central and outer peripheral regions. More specifically, the central region of the upper plate 4 is formed with a circular-shaped hole 4*a* serving as a water inlet port for inserting the joint 8 therethrough, and an annular-shaped convex portion 4*b* surrounding the hole 4*a* and receiving therein a flange 8*a* of the joint 8. This convex-portion 4*b* is formed with four holes 4*c* for inserting therethrough four screws 10*a* for fastening the upper plate 4 and the joint 8 together. The outer peripheral region of the upper plate 4 is formed as an annular-shaped rim portion 4*d*. The rim portion 4*d* is formed with sixteen holes 4*e* for inserting therethrough sixteen screws 16*b* serving as a plurality of fasteners.

With reference to FIGS. 1 and 3, the channel-defining member 6 will be described in detail below.

The channel-defining member 6 is formed of an approximately circular disc-shaped elastic member. In this embodiment, the channel-defining member 6 is made of silicon rubber. Alternatively, the channel-defining member 6 may be made of another rubber material, such as EPDM (Ethylene Propylene Dien Monomer), or a soft resin material, such as TPE (Thermoplastic Elastomer). As shown in FIG. 1, the channel-defining member 6 has a top surface formed with an annular-shaped outermost peripheral wall 6*a*, and twenty-eight arc-shaped channel walls 6*b* arranged concentrically. Based on these channel walls 6*c*, four effective channels extending radially from the center of the channel-defining member 6, and seven effective channels 6*d* extending concentrically, are defined on the top surface of the channel-defining member 6.

As shown in FIGS. 2 and 3, the channel-defining member 6 has a bottom surface formed with a number of approximately columnar-shaped discharging nozzles 6*e* each having a rounded distal end. Each of the discharging nozzles 6*e* is formed at a position corresponding to each of the discharging holes 2*c* of the lower plate 2, and inserted through each of the discharging holes 2*c* to protrude downward from the lower plate 2. Each of the discharging nozzles 6*e* is formed with a nozzle hole 6*f* extending along an axis thereof. This nozzle hole 6*f* vertically penetrates the channel-defining member 6 to extend between the tip of the discharging nozzle 6*e* and a corresponding one of the effective channels 6*c* and 6*d*. Further, as shown in FIG. 3, each of the channel walls 6*b* has a height which increases in a direction from the periphery to the center the channel-defining member 6. That is, on the basis of a height of the outermost channel wall 6*b*, respective heights of the remaining channel walls 6*b* increase stepwise as they are disposed closer to the center of the channel-defining member 6.

As shown in FIG. 1, in addition to the flange 8*a*, the joint 8 has a connection portion 8*b* formed on the upper side of the flange 8*a* to have a diameter less than that of the flange 8*a*. The joint 8 is formed with a through-hole 8*c* extending along an axis thereof to allow hot water fed thereto to flow therethrough. The flange 8*a* is formed with four internally-threaded holes 8*d*, and the joint 8 is fastened to the upper plate 4 by the four screws 10*a*. The flange 8*a* is formed to have a shape capable of being received in the convex portion 4*b* of the upper plate 4, and allowing a bottom surface of the flange 8*a* to be flush with a bottom surface of the upper plate 4 in a state after the joint 8 is fastened to the upper plate 4.

In an assembling process for the showerhead 1, the joint 8 is firstly fastened to the upper plate 4 by the screws 10*a*. Then, the channel-defining member 6 is sandwiched between the upper plate 4 and the lower plate 2, and the upper plate 4 is finally fastened to the lower plate 2 by the screws 10*b*. In a state after assembling of the showerhead 1, the channel-defining member 6 is elastically deformed to allow respective top surfaces of the channel walls 6*b* and the outermost peripheral wall 6*a* to be in watertight contact with the bottom surface of the upper plate 4. This makes it possible to define the watertight effective channels between the outermost peripheral wall 6*a* and the channel wall 6*b* and between the channel walls 6*b*. Further, respective regions where the channel walls 6*b* and the outermost peripheral wall 6*a* are in contact with the upper plate 4 are formed to preclude hot water from getting thereinto so as to serve as an ineffective channel.

As described above, each of the channel walls 6*b* is formed to have a height which increases in the direction from the periphery to the center. Thus, an amount of elastic deformation in the channel-defining member 6 caused by being sandwiched between the lower plate 2 and the upper plate 4 further increases at a position closer to the central region far from the peripheral region fastened by the screws 10*b*. Thus, even if each of the lower plate 2, the upper plate 4 and the channel-defining member 6 is not formed to have complete flatness, the channel walls 6*b* and the outermost peripheral wall 6*a* can be reliably brought in contact with the upper plate 4 to ensure water-tightness in each of the effective channels.

An operation of the showerhead 1 according to the first embodiment will be described below. Firstly, hot water fed from the pipe (not shown in FIGS. 1 to 3) to the joint 8 connected to the pipe flows in the showerhead 1 through the through-hole 8*c* of the joint 8. The hot water flowing vertically downward through the through-hole 8*c* flows horizontally through the inside of the showerhead 1 along each of the effective channels 6*c*, 6*d* defined between the channel-defining member 6 and the upper plate 4. The hot water flowing through the effective channels 6*c*, 6*d* is discharged through the number of nozzle holes 6*f* formed in each of the effective channels while forming streamlines oriented approximately vertically downward. As used in this specification, the term "streamline" means a line-shaped flow of hot water discharged from each of the nozzle holes 6*f*.

The outermost peripheral wall 6*a* and the bottom surface of the upper plate 4 is in watertight contact with one another to prevent hot water entered in the showerhead 1 from getting out beyond the outermost peripheral wall 6*a*. Further, no hot water gets into the regions where the channel walls 6*b* and the upper plate 4 are in contact with each other, and thereby no water pressure acts on these contact regions. Thus, a water pressure is applied only to a region of the upper plate 6 corresponding to the effective channels 6*c*, 6*d*.

As above, in the showerhead according to the first embodiment, hot water entered between the upper and lower plates flows through the effective channels without flowing through the ineffective channel, and thereby no pressure is applied to the region of the upper plate corresponding to the ineffective channel. Thus, a force caused by a water pressure to be applied to the upper plate can be significantly reduced. This makes it possible to prevent damages in the upper or lower plate or other component and water leakage, even in a large-size showerhead as in this embodiment.

Further, in the showerhead according to the first embodiment, hot water remains only in the effective channels within the showerhead. Thus, an amount of the residual hot water is significantly reduced. In addition, each of the effective channels is formed to have a relatively low height, and thereby a pressure head causing discharge of residual hot water in the showerhead is significantly lowered. This makes it difficult for outside air to overcome surface tension of the residual water and get into the showerhead, so as to prevent water dripping after stop of water discharge. Even if water dripping occurs, the sense of use of the showerhead will not be spoiled because of the significantly small amount of residual hot water in the showerhead.

Furthermore, in the showerhead according to the first embodiment, each of the channel walls is formed to have a height which increases in the direction from the periphery to the center, and thereby an amount of compressive deformation in the channel-defining member 6 increases at a position farther from the screws fastening between the lower and upper plates. This makes it possible to reliably bring the upper plate into contact with the channel walls even if the lower or upper plate is not formed to have complete flatness.

While the showerhead according to the first embodiment is designed to define the effective channels between the upper plate and the channel-defining member, the effective channels may be defined between the lower plate and the channel-defining member. Further, the lower plate, the upper plate the channel-defining member may be integrally formed to provide a showerhead.

Figure 4:
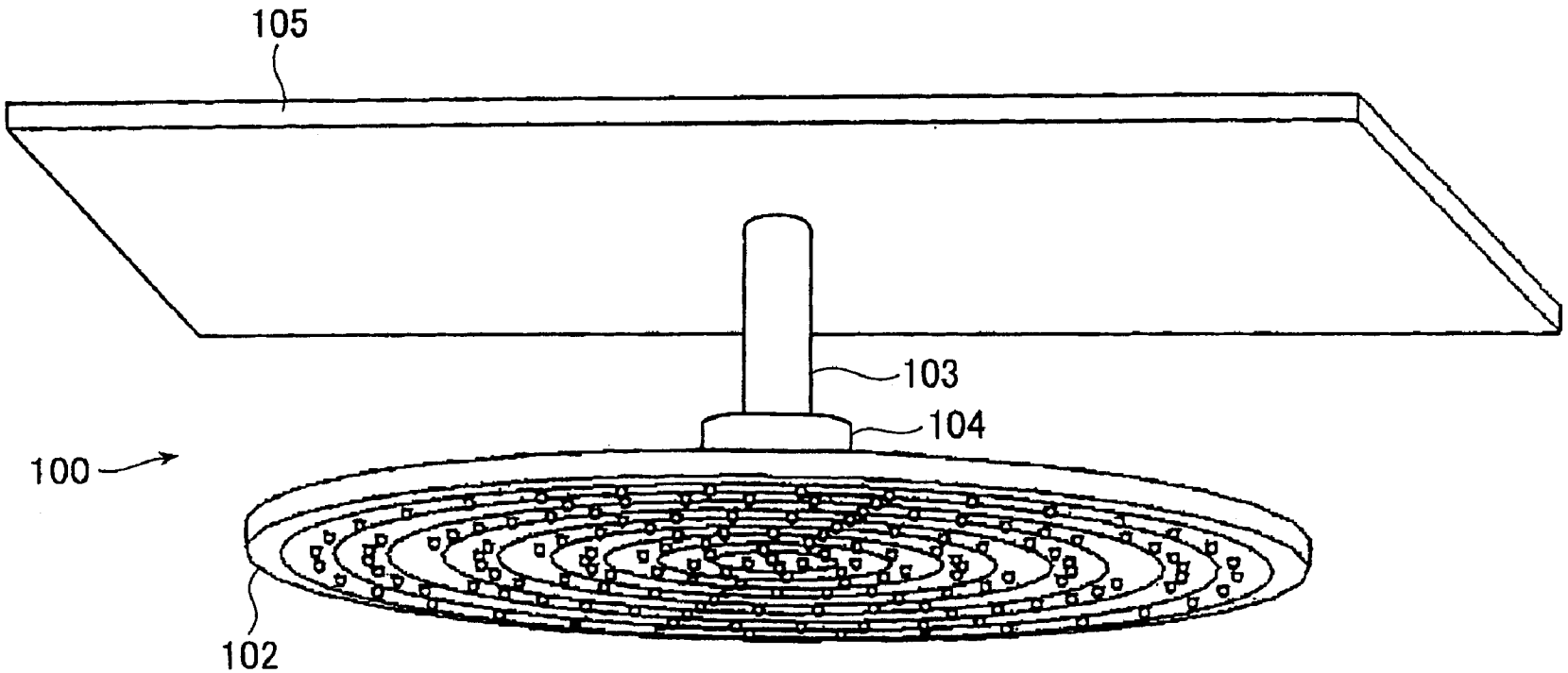
FIG. 4 is a perspective external view showing a shower device having a showerhead according to a second embodiment of the present invention.
Figure 5:
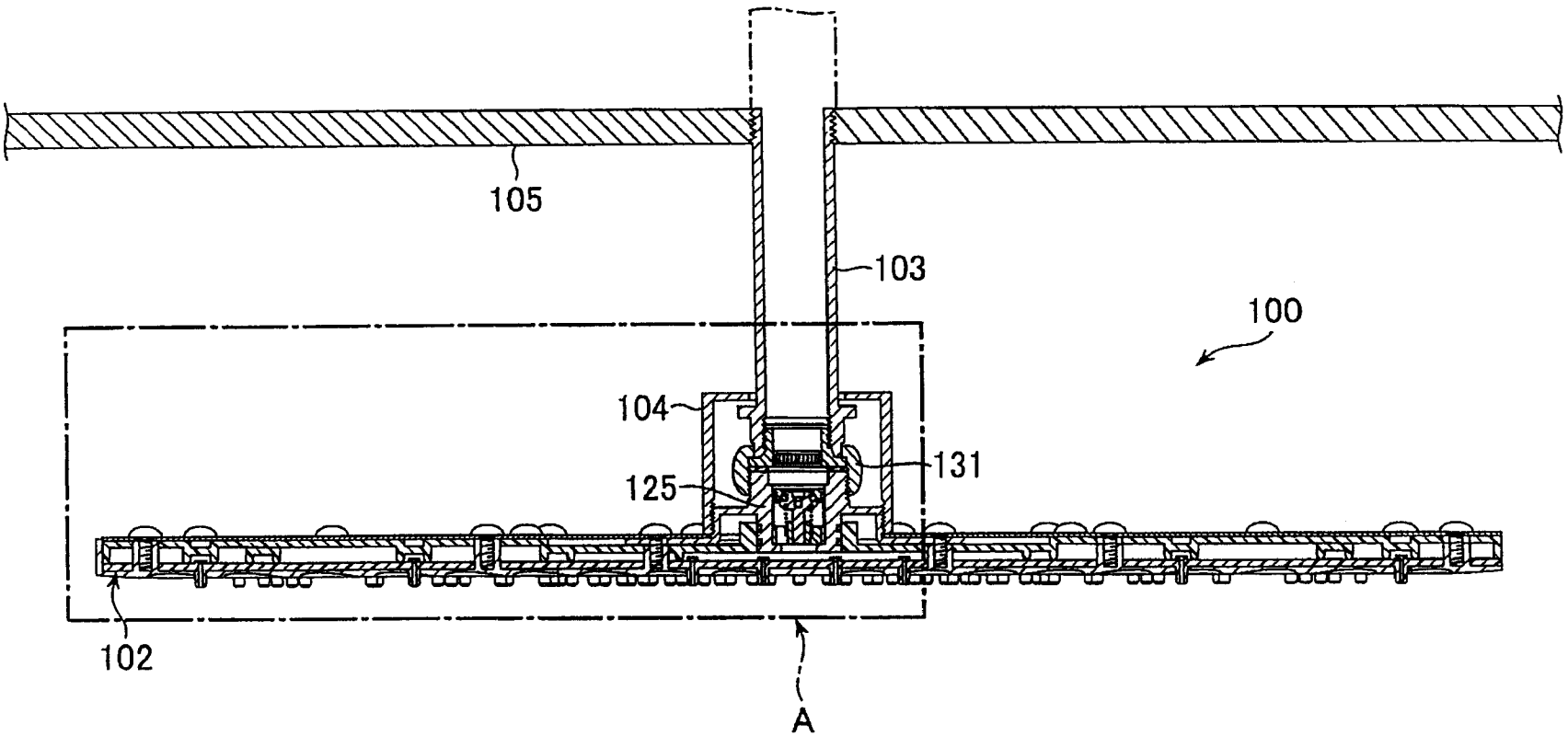
FIG. 5 is a sectional view showing the shower device having a showerhead according to a second embodiment of the present invention.

Secondly, with reference to FIGS. 4 and 17, a showerhead according to a second embodiment of the present invention will be described. FIG. 4 shows a shower device 100 having the showerhead 102 according to the second embodiment, and FIG. 5 is a sectional view showing the shower device 100 in FIG. 4. In the shower device 100; the showerhead 102 is provided a showerhead body 121 formed in a flat shape, a watertight member 122 and a shower plate 123, and mounted to a ceiling surface 105 of a bathroom or a shower room in a horizontal posture. As shown in FIG. 5, in this shower device 100, the showerhead 102 is connected through a joint 125 integrally fastened to the showerhead 102, to a pipe 103 installed in the ceiling surface 105 to extend vertically, by use of a cap nut 131, and finally a connection between the showerhead 102 and the cap nut 131 is covered by a cap 104.

Figure 6:
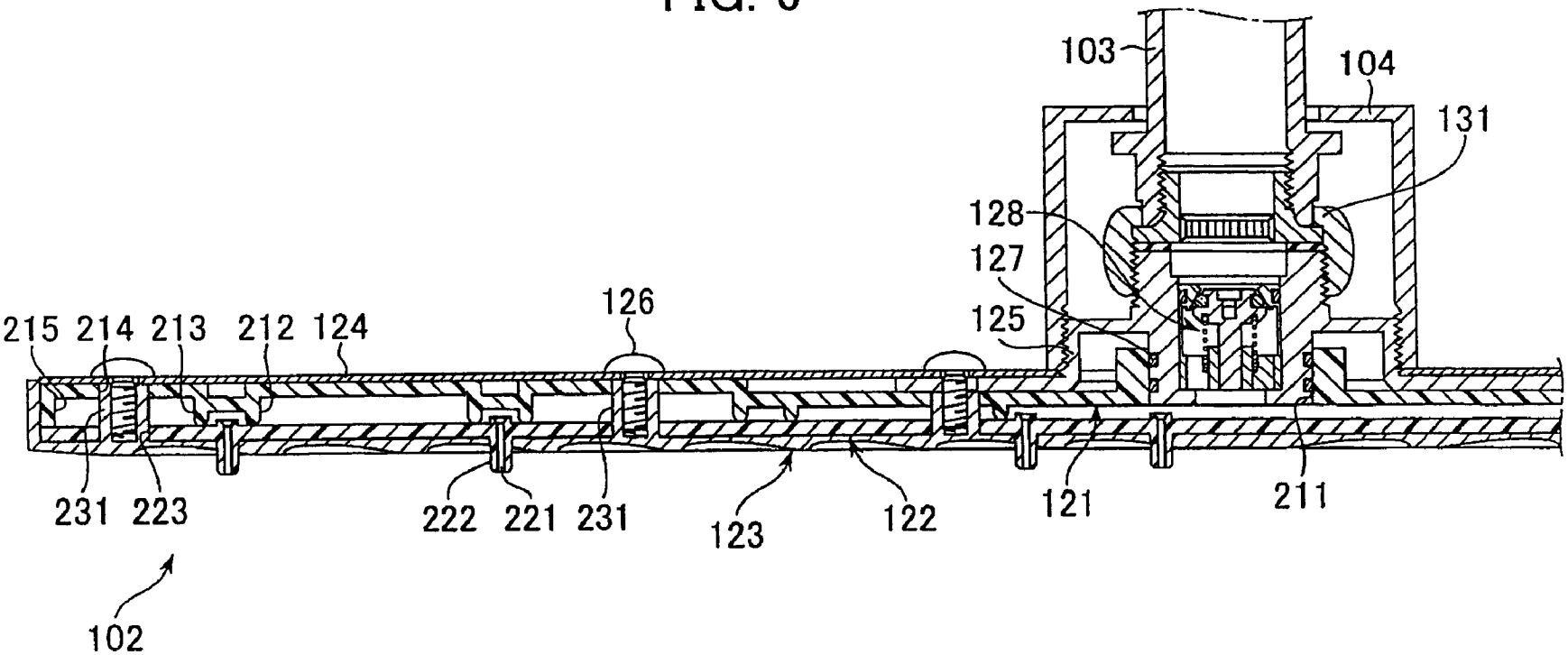
FIG. 6 is an enlarged view showing the area A in FIG. 5.

FIG. 6 is an enlarged view showing an internal structure of the showerhead 102 or the area A in FIG. 5. In the showerhead 102 comprising the showerhead body 121, the watertight member 121 and the shower plate 123, the watertight member 122 is disposed above the shower plate 123, and the showerhead body 121 is disposed above the watertight member 122 to form a stacked structure. The showerhead body 121 has a water inlet port 211 formed at a central region of a circular shape thereof, and an O-ring 127 is disposed in the water inlet port 211. The joint 125 is internally provided with a check valve 128, and connected to the water inlet port 211 a part of an upper surface of the joint 125 is covered by a back cover 124.

The showerhead body 121 and the back cover 124 in the second embodiment serve as the upper plate and the channel-defining member in the first embodiment. Further, the watertight member 122 and the shower plate 123 serve as the lower plate in the first embodiment.

The shower plate 123 is formed with a plurality of fastening-screw receiving portions 231 each having an internally-threaded hole to serve as a fastener-receiving portion. A plurality of fastening screws 126 are driven from above the back cover 124 and engaged, respectively, with the fastening-screw receiving portions 231. Based on a fastening force of the fastening screws 126, the showerhead body 121, the watertight member, the back cover 124 and the joint 125 are fastened together to form the showerhead 102.

The watertight member 122 is provided with a plurality of discharging nozzles 222 each of which is formed with a nozzle hole 221 having an inner diameter of about 1 mm, and arranged concentrically. Water from a water supply line (not shown) extending on the back side of the ceiling surface 105 flows in the showerhead 102 through the pipe 103, and then flows out through the nozzle holes 221 so as to achieve discharge of shower water from the shower device 100.

Figure 7:
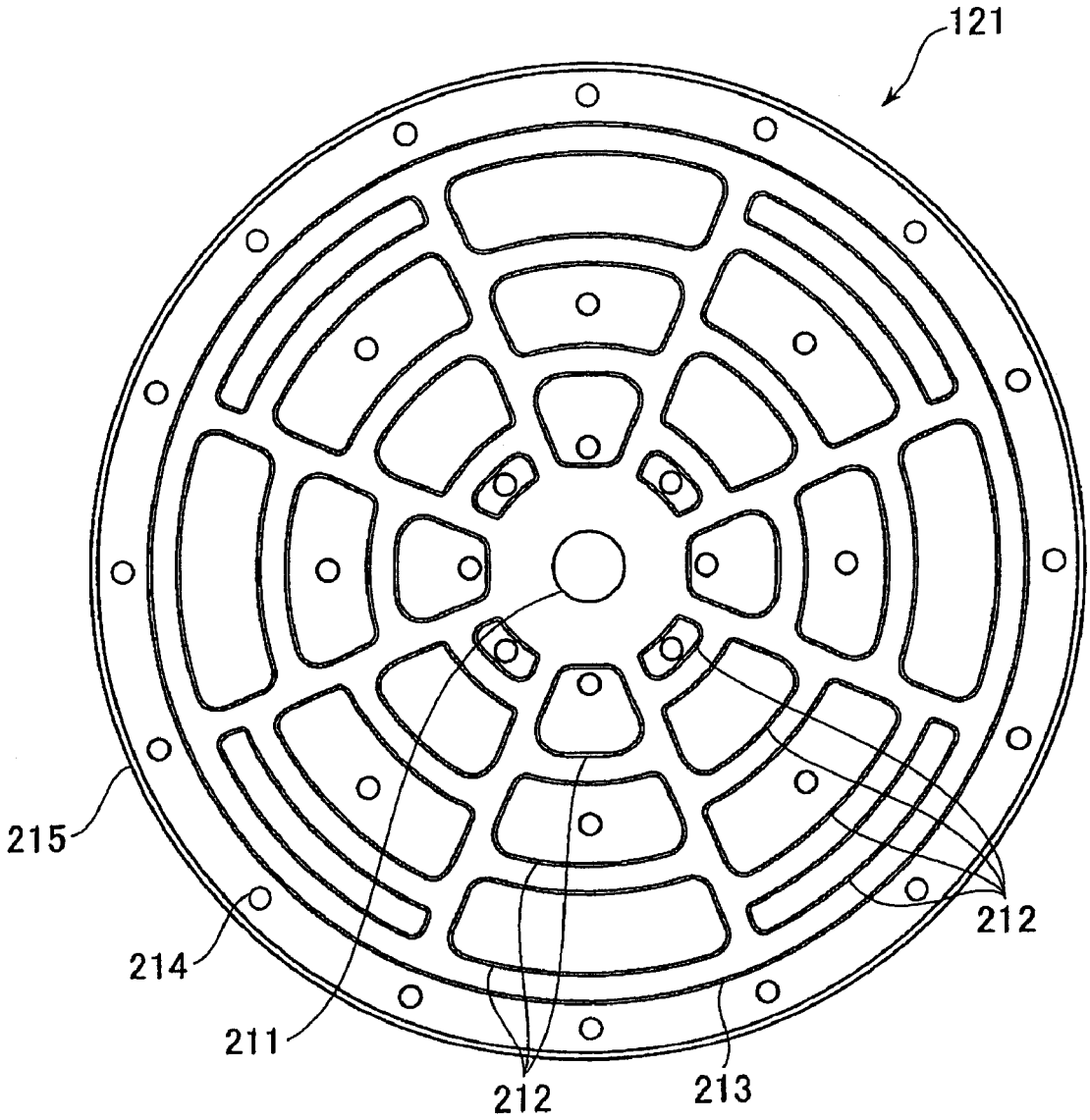
FIG. 7 is a front view showing a showerhead body of the showerhead according to the second embodiment.

FIG. 7 shows the showerhead body 121. The showerhead body 121 is made of a hard resin material and formed in a circular disc shape. The water inlet port 211 is formed in the central region of the showerhead body 121 to allow the joint 125 to be inserted therein. The showerhead body 121 has a bottom surface disposed in opposed relation to the watertight member 122 and formed with a plurality of approximately rectangular-shaped channel walls 212 arranged along a plurality lines extending radially from the water inlet port 211. Each pair of laterally or vertically adjacent channel walls 212 are arranged in spaced apart relation to one another at a given distance.

As shown in FIG. 7, the showerhead body 121 is also formed with an outermost peripheral wall 215 extending along the entire circumference thereof, and a circular wall 213 extending entirely along the circumferential direction on the inward side relative to outermost peripheral wall 215. Further, the showerhead body 121 is formed with a plurality of through-holes 214 along three concentric circles on the basis of the water inlet port 211 and at respective positions corresponding to the fastening-screw receiving portions 231 of the shower plate 123. As shown in FIG. 6, each of the fastening-screw receiving portions 231 is inserted into a corresponding one of the through-holes 214 of the showerhead body 121.

Figure 8:
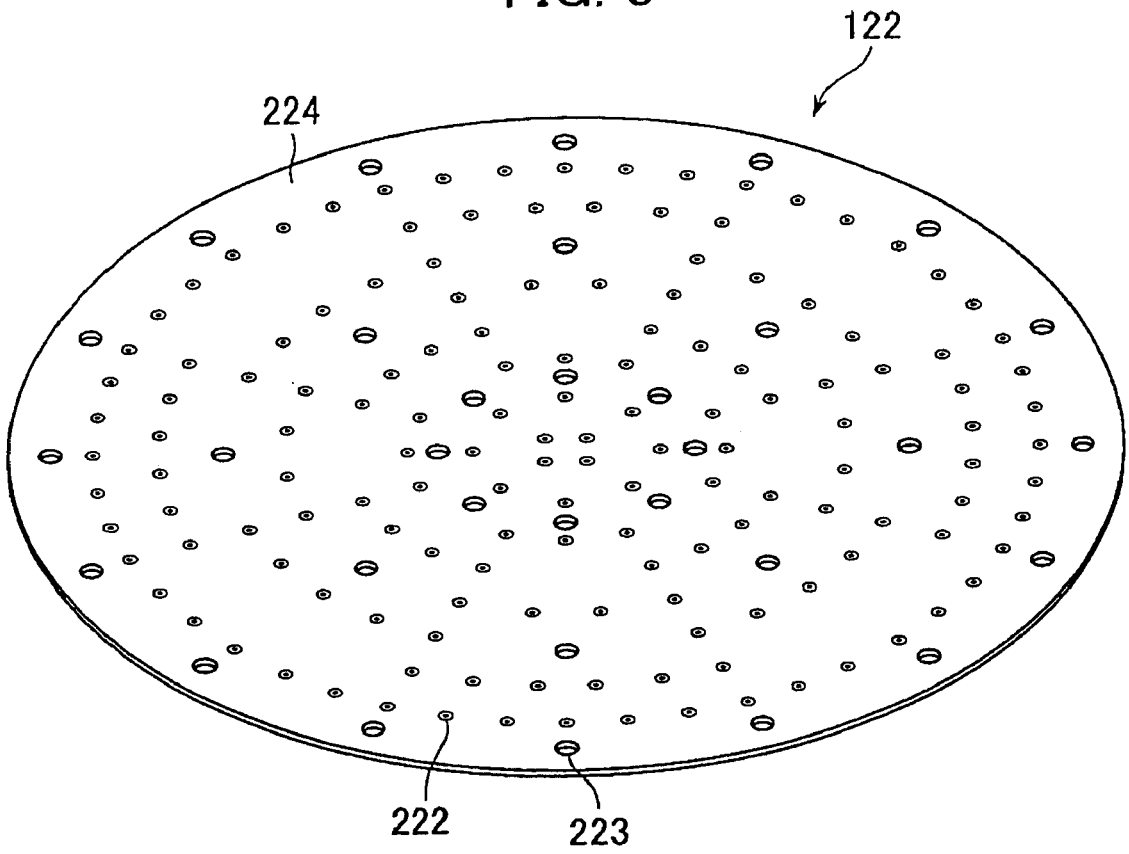
FIG. 8 is a perspective view showing a watertight member of the showerhead according to the second embodiment.

FIG. 8 is a perspective view of the watertight member 122. The watertight member 122 is made of rubber or a soft resin material. The watertight member 122 has a circular disc-shaped watertight portion 224 positioned to extend horizontally as with the showerhead body 121, and the plurality of discharging nozzles 222 each formed with the nozzle hole 221. Each of the nozzle holes 222 is arranged at a position corresponding to each of the discharging holes 233 formed in the shower plate 123. Further, the nozzle holes 222 are arranged such that, when the watertight member 122 is brought into contact with the showerhead body 121, the nozzle holes 222 are disposed in opposed relation to respective regions between the adjacent channels 212 and between the channels 212 and the circular wall 213 formed in the showerhead body 121. As with the showerhead body 121, the watertight member 122 has a plurality of through-holes 223 each formed at a position corresponding to each of the fastening-screw receiving portions 231 of the shower plate 123. Each of the fastening-screw receiving portions 231 is inserted through a corresponding one of the through-holes 223 of the showerhead body 122.

Figure 9:
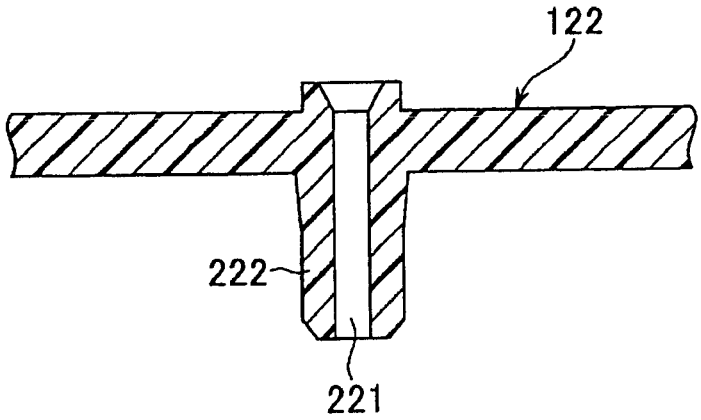
FIG. 9 is an enlarged sectional view showing a discharging nozzle in the watertight member of the showerhead according to the second embodiment.

The nozzle hole 221 and discharging nozzle 222 of the watertight member 122 will be described in more detail below with reference to FIG. 9 which is an enlarged sectional view showing the discharging nozzle 222. The nozzle hole 221 is formed to extend in a direction perpendicular to a circular disc-shaped body of the watertight member 122 positioned to extend horizontally. As compared with a case where the nozzle hole 221 is formed to extend obliquely, the vertically-extending nozzle hole 221 can increase surface tension of residual hot water in the shower head 102 during stop of water discharge to suppress water dripping. In addition, the vertically-extending nozzle hole 221 makes it possible to allow shower water to fall vertically toward a floor surface, and maintain an aesthetic form of shower water without contact between streamlines.

Further, in the discharging nozzle 222, a portion of the nozzle hole 221 on the side of a discharge opening thereof or on a downstream side of a hot water flow is surrounded by a relatively thick wall, and formed to protrude downward from the shower plate 123 at a sufficient length. Thus, even if the nozzle hole 221 is clogged due to extraneous matter or the like, the discharging nozzle 222 made of a soft material and formed to protrude from the shower plate 123 can be repeatedly compressed by fingers to readily remove the extraneous matter without disassemble of the shower device.

Figure 10:
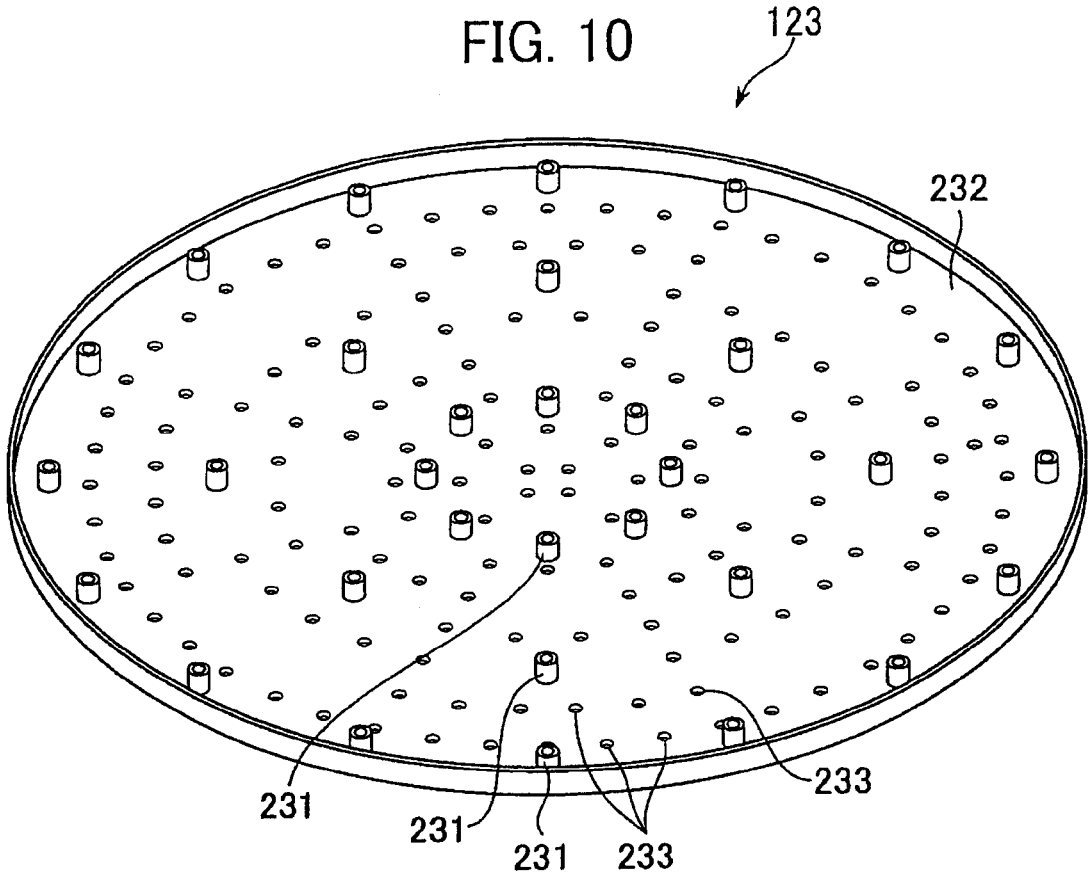
FIG. 10 is a perspective view showing a shower plate of the showerhead according to the second embodiment.

FIG. 10 is a perspective view showing the shower plate 123. The shower plate 123 is made of metal and formed in a circular disc shape. The shower plate 123 has a flat back surface 232, and an outer peripheral portion extending upright. This upright outer peripheral portion can visually conceal the showerhead body 121 and the watertight member 122 from outside to provide enhanced aesthetic appearance. Each of the discharging holes 233 in the back surface 232 is arranged at a position corresponding to each of the discharging nozzles 222, and formed to have a diameter slightly greater than that of the discharging nozzle 222. Thus, when the watertight member 122 is superimposed on the shower plate 123, each of the discharging nozzles 222 protrudes from a corresponding one of the discharging holes 233. The plurality of fastening-screw receiving portions 231 each having the internally threaded hole are formed along three concentric circles on the back surface 232 to protrude upward.

Figure 11:
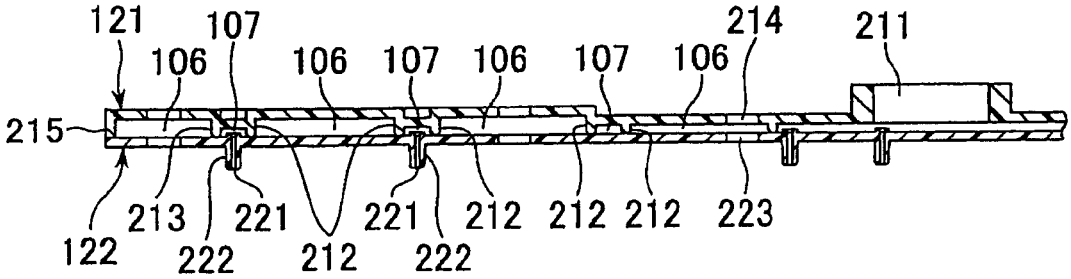
FIG. 11 is a sectional view showing the structure of ineffective and effective channels defined by the showerhead body and the watertight member of the showerhead according to the second embodiment.

FIG. 11 is an enlarged sectional view showing the showerhead body 121 and the watertight member 122 superimposed on one another. When the showerhead body 121 is superimposed on the watertight member 122, the plurality of channel walls 212 and the circular wall 213 formed in the showerhead body 121 are brought into contact with the watertight member 122. This contact between the channel walls 212/circular wall 213 and the watertight member 122 makes it possible to define a plurality of effective channels 107 between the adjacent channel walls and between the circular wall 213 and each of the outermost channel walls 212. Simultaneously, a plurality of ineffective channels 106 are defined in a region on the outward side relative to an outer periphery of the circular wall 213 and in respective regions corresponding to the channel walls 212.

In a state after the effective channels 107 and the ineffective channels 106 are defined, water fed from the water inlet port 211 passes only through the effective channels 107 without getting into the ineffective channels 106. The discharging nozzles 222 are arranged in the regions of the watertight member 122 defining the effective channels 107. Thus, the hot water flowing through the effective channels 107 is discharged as shower water from the nozzle holes 221 formed in the discharging nozzles 222. Further, no water pressure acts on the regions corresponding to the ineffective channels 106 having no hot water getting thereinto.

As shown in FIG. 6, in an assembling process for the showerhead 102, the shower plate 123, the watertight member 122 and the showerhead body 121 are superimposed on each other in this order in such a manner as to allow each of the fastening-screw receiving portions 231 of the shower plate 123 to be inserted a corresponding one of the through-holes 223 of the watertight member 122 and into a corresponding one of the through-holes 214 of the showerhead body 121. Then, the back cover 124 is superimposed on the showerhead body 121, and each of the fastening screws 126 serving as a fastener is driven into a corresponding one of the fastening-screw receiving portions 231 from above the back cover 124. Thus, a fastening force of the fastening screws 126 is applied to the showerhead body 121 through the back cover 124, so that the channel walls 212 and the circular wall 213 are brought into contact with the watertight member 122 to define the effective channels 106 and the ineffective channels 107 in the inside of the showerhead 102.

Each of the through-holes 214 of the showerhead body 121 is arranged within the ineffective channels 106. This prevents hot water from getting between the fastening-screw receiving portions 231 and the back surface 232 of the shower plate 123 to climate the risk of water leakage from the discharging holes 233.

Further, when the showerhead body 121 and the watertight member 122 are fastened together, the outermost peripheral wall 215 of the showerhead body 121 is brought into watertight contact with the watertight member 122 to eliminate the risk of water leakage from between the showerhead body 121 and the shower plate 123.

In order to provide further enhanced water-tightness, each edge of the channel walls 212, the circular wall 212 and the outermost peripheral wall 215 may be chamfered to reduce an area to be in contact with the watertight member 122 so as to increase a compressive force per unit area relative to the watertight member 122. Alternatively or additionally, the showerhead body 121, the watertight member 122 and the back surface 232 of the shower plate 123 may be improved in flatness, or the fastening screws 126 may be evenly arranged, so as to further improve water-tightness When water-tightness is ensured in the above manner, the ineffective channels 106 and the effective channels 107 will be defined. This makes it possible to prevent a water pressure from acting on the entire surface of the shower head 102. The reduced internal area of the shower head 102 to be subjected to a water pressure allows a force caused by a water pressure acting on the components of the shower head 102 to be lowered. This makes it possible to prevent damages or dropping-off of the component of the shower head 102 and water leakage.

Figure 12:
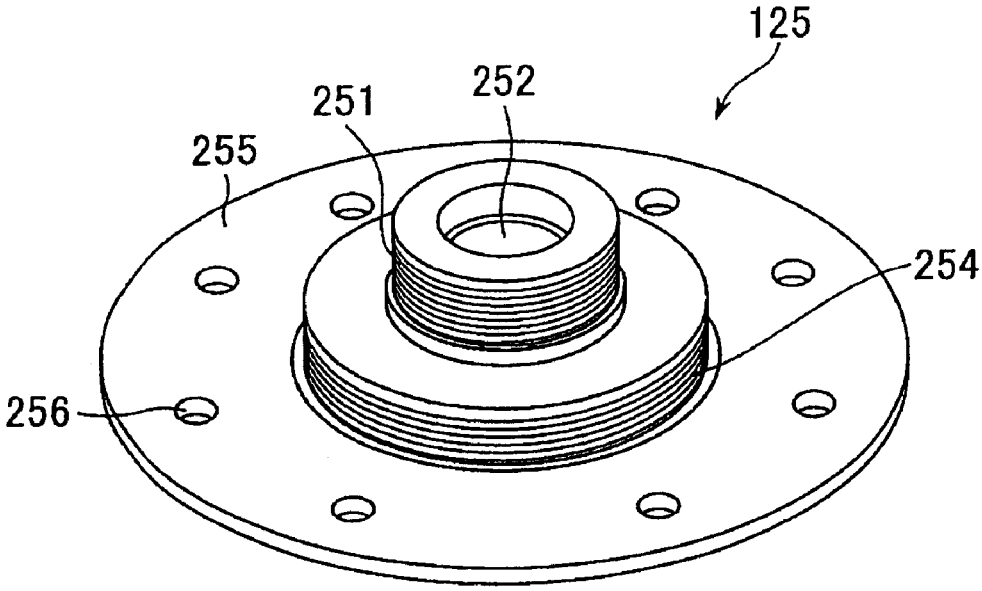
FIG. 12 is a perspective view showing a joint to be connected to the showerhead according to the second embodiment.
Figure 13:
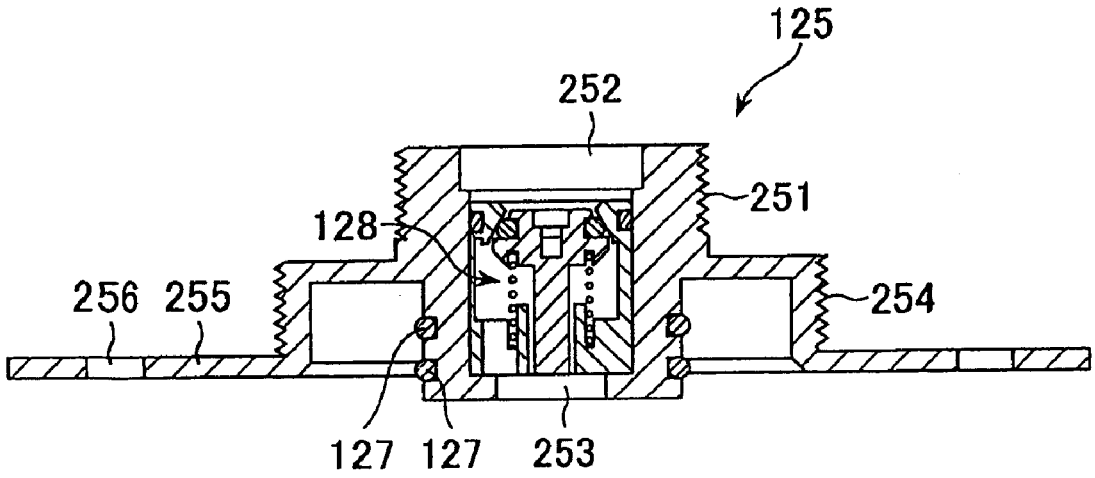
FIG. 13 is a sectional view showing the joint to be connected to the showerhead according to the second embodiment.

FIG. 12 is a perspective view showing the joint 125 connecting the shower head 102 and the pipe 103, and FIG. 13 is a sectional view showing the joint 125. As shown in FIGS. 12 and 13, the joint 125 has a first externally-threaded portion 251 engageable with the cap nut 131, and an inlet opening 252 formed in a top surface thereof to receive water from the pipe 103. The joint 125 also has an outlet 253 formed in a bottom surface thereof to feed the water to the showerhead 102, and an O-ring 253 is mounted on an outer peripheral surface thereof. Further, the check valve 128 is disposed between the inlet opening 252 and the outlet opening 253.

Further, the joint 125 has a second externally-threaded portion 254 on the outward side relative to the first externally-threaded portion 251, and a joint flange 255 extending radially outward from a lower edge of the second externally-threaded portion 254. The joint flange 255 is formed with a plurality of joint through-holes 256 at respective positions corresponding to the fastening-screw receiving portions 231 of the shower plate 123.

The check valve 128 housed in the joint 125 prevents outside air from flowing back into the shower head 102 through the nozzle holes 221 due to a pressure difference between the inside of the showerhead 102 and outside air when the shower device 100 stops supplying water. The blow-back of air into the showerhead 102 destroys surface tension of water in the showerhead 1-2 to cause water dripping. In this embodiment, the check valve 128 operates immediately after stop of water supply to maintain surface tension of water in the showerhead 102 and keep an internal pressure of the showerhead 102 at a constant value so as to prevent outside air from getting into the showerhead 102 through the muzzle holes 211.

Figure 14:
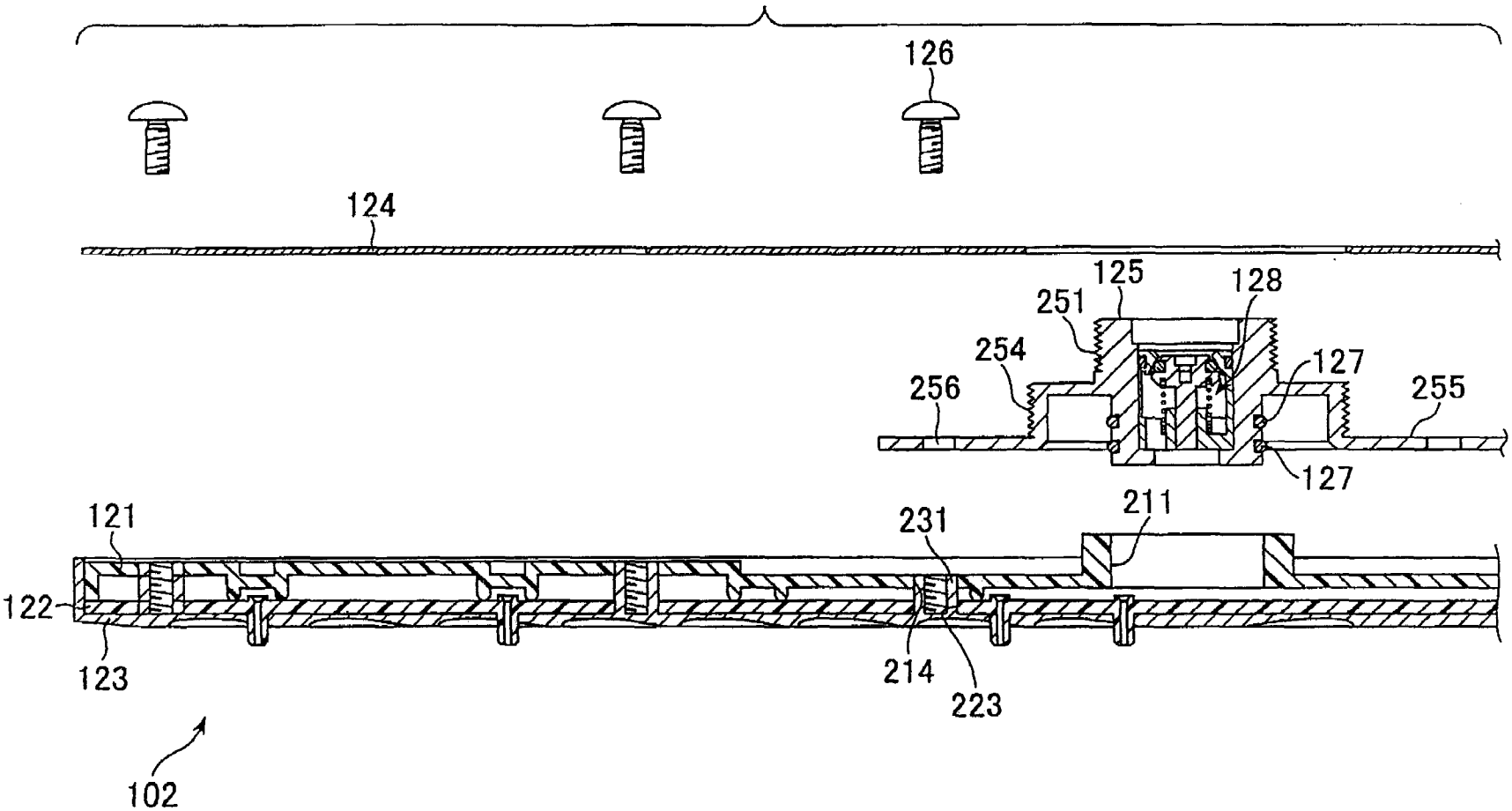
FIG. 14 is a sectional view showing a connection structure for the showerhead according to the second embodiment.

With reference to FIG. 14, a process for attaching the joint 125 to the showerhead 102 will be described below. Firstly, the O-ring 127 is mounted on the joint 125, and a lower portion of the joint 125 having the O-ring mounted thereon is inserted into and connected to the water inlet port 211 of the showerhead body 121. Further, the back cover 124 is placed on the joint 125 while allowing the second externally-threaded portion 254 to be exposed outside. Then, the fastening screws 126 are engaged with the corresponding fastening-screw receiving portions through the corresponding joint through-holes 256, the corresponding through-holes 213 of the showerhead body 121 and the corresponding through-holes 223 of the watertight member 122, so as to fasten the joint 125 and the showerhead 2 together. Even if the fastening screws 126 engaged through the joint through-holes become loose or are disengaged, the joint flange 255 restrained by the back cover 124 can prevent dropping-off of the showerhead 102.

Figure 15:
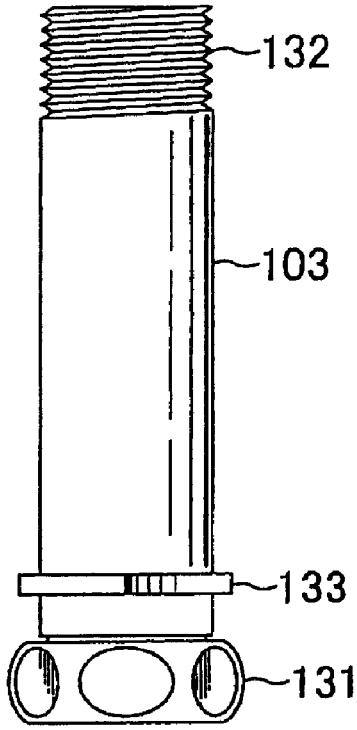
FIG. 15 is a front view showing a pipe for feeding water to the showerhead according to the second embodiment.
Figure 16:
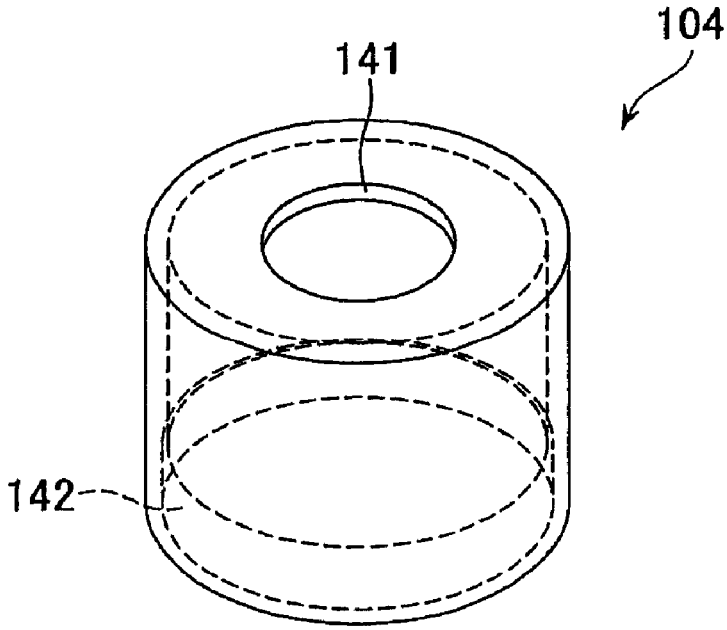
FIG. 16 is a perspective view showing a cap to be attached to the showerhead according to the second embodiment.

With reference to FIGS. 15 and 16, respective structures of the pipe 103 provided between the ceiling surface 105 and the showerhead 102, and the cap 104 concealing the connection between the pipe 103 and the showerhead 102, will be described below.

FIG. 15 is a front view showing the pipe 103. As shown in FIG. 15, the pipe 103 has the cap nut 131, and the cap nut 131 is threadingly engaged with the first externally-threaded portion 251 of the joint 125. One end of the pipe 1003 on the opposite side of the cap nut 131 is formed as an externally-threaded portion 132 engageable with the water supply line (not shown) extending along the back side of the ceiling surface 105. The pipe 103 is further formed with a pipe collar 133 on the upper side of the cap nut 131.

FIG. 16 is a perspective view showing the cap 104. As shown in FIG. 16, the cap 104 has an upper portion formed with a pipe insertion hole 141 having a diameter greater than an outer diameter of the pipe 103. The cap 104 further includes an inner wall having an internally-threaded portion engageable with the second externally-threaded portion 254 of the joint 125.

Figure 17:
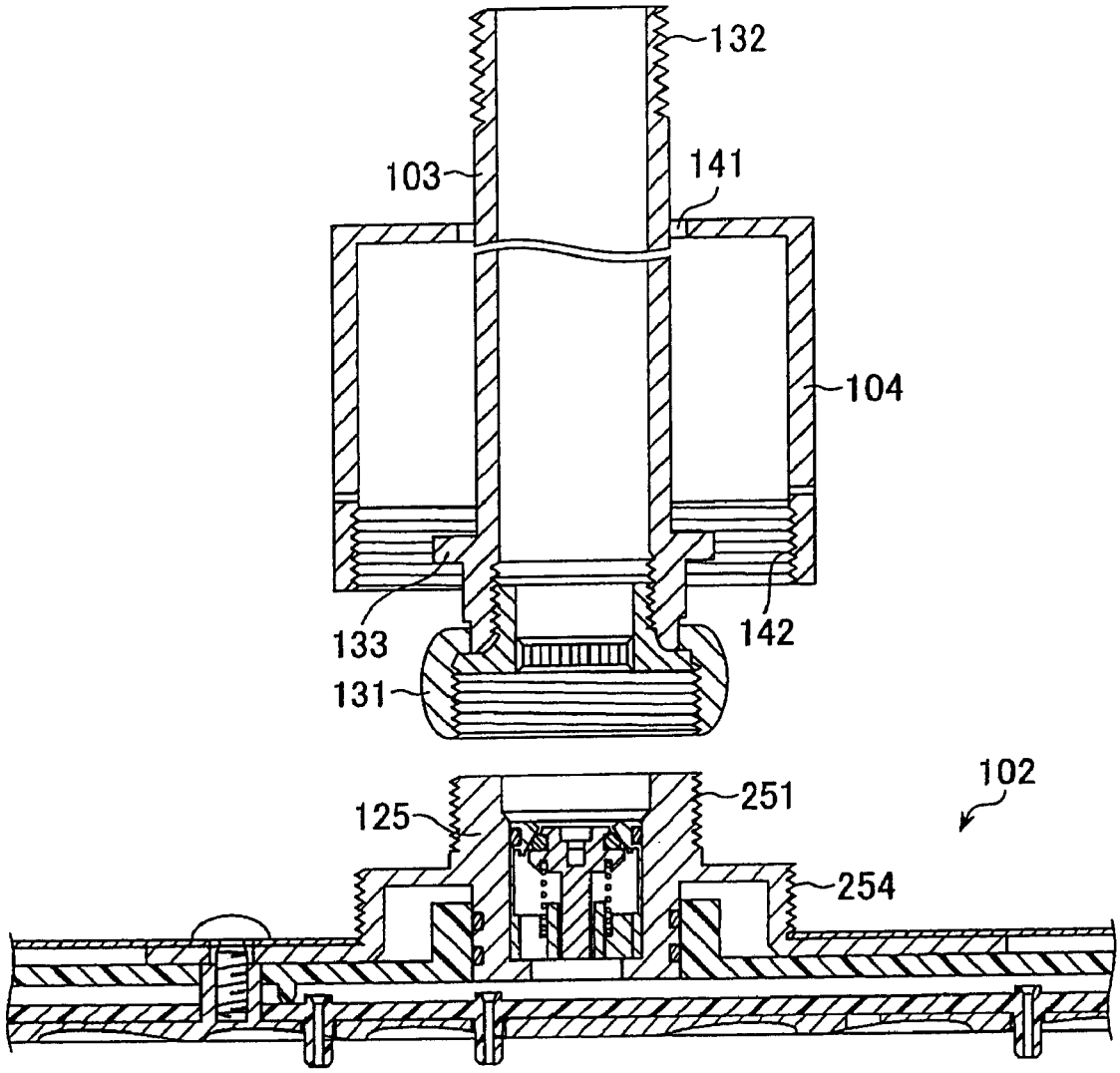
FIG. 17 is a sectional view showing a connection structure between the showerhead according to the second embodiment and the pipe in FIG. 15/the cap in FIG. 16.

With reference to FIG. 17, a process for connecting between the ceiling surface 105 and the pipe 103 and between the pipe 103/cap 104 and the showerhead 102 will be described below. Firstly, the externally-threaded portion 132 of the pipe 103 is inserted into the pipe insertion hole 141 of the cap 104, and threadingly engaged with and connected to the water supply line (not shown) extending along the back side of the ceiling surface 105. The pipe collar 133 of the pipe 103 is formed in a hexagonal shape in section, and a tool can be hooked onto the pipe collar 133 to connect the water supply line and the externally-threaded portion 132 together without difficulty.

Then, the cap nut 131 of the fixed pipe 103 is threadingly engaged with the first externally-threaded portion 251 of the joint 125 to connect the pipe 103 and the joint 125 together. Then, the internally-threaded portion 142 of the cap 104 is engaged with the second externally-threaded portion 254. In a state after the cap 104 is threadingly engaged with the joint 125, a slight gap is left between the cap 104 and the pipe collar 133. In this manner, the shower device 100 is connected to the water supply line.

In the shower device 100 connected to the water supply line using the above structure, both a weight of the shower head 102 and a water pressure during discharge of shower water are imposed on the connection between the cap nut 131 and the first externally-threaded portion 251 of the joint 125. Thus, a relatively large shearing stress is applied to the connection between the cap nut 131 and the first externally-threaded portion 251. In this embodiment, the internally-threaded portion 142 of the cap 140 and the second externally-threaded portion 254 of the joint 125 are engaged with one another. Thus, even if the connection between the cap nut 131 and the first externally-threaded portion 251 becomes loose or is released, the cap 104 is brought into contact with the pipe collar 133 to prevent dropping-off of the showerhead 102.

While the preferred embodiments of the present invention have been described, various modifications and changes may be made therein. Particularly, while the showerhead according to the above embodiments has been mounted to a ceiling of a bathroom or a shower room, the showerhead of the present invention may be connected to a water supply line unstapled in a wall surface.

Further, while the showerhead according to the second embodiment has been provided with the showerhead body, the watertight member, the shower plate and the back cover, and designed to integrally form the channel walls, the circular wall and others, each of the members or elements may be partly formed integrally or separately according to need. For example, the channel walls and/or the circular wall may be formed separately from the showerhead body, or the channel walls and/or the circular wall may be integrally formed with the watertight member.

What is claimed is:

1. A showerhead comprising:

a lower plate formed with a plurality of discharging holes for discharging shower water therethrough;

an upper plate connected to said lower plate and formed with a single water inlet port at the center of said upper plate; and a channel-defining member having arc-shaped channel walls disposed between said lower and upper plates to define an effective channel between said arc-shaped channel walls, said effective channel including at least one channel extending radially from the center of said channel-defining member and at least one channel extending concentrically around the center of said channel-defining member, and an ineffective channel between said lower and upper plates, said effective channel allowing hot water entering said single water inlet port to be led to each of said discharging holes disposed around the periphery of said single water inlet port, said ineffective channel reducing a pressure-receiving area of said lower or upper plate to be subjected to a water pressure.

2. The showerhead according to claim 1, wherein:

said lower plate and said upper plate have mutually opposed surfaces at least partly formed to be approximately flat and parallel to one another, said lower plate and said upper plate being joined together along their outer peripheral regions while sandwiching said channel defining member between said approximately flat and parallel regions thereof;

and said channel-defining member is disposed in contact with said lower plate or said upper plate, and provided with a channel wall defining said effective channel in cooperation with said lower plate or said upper plate, said channel wall being formed to have a height which increases in a direction from the periphery to the center of said channel-defining member.

3. A showerhead provided with a shower plate formed with a plurality of discharging holes for discharging shower water therethrough and a showerhead body connected to said shower plate and formed with a single water inlet port at the center of said showerhead body, and designed to allow hot water entered from said water inlet port to be discharged through said discharging holes disposed around the periphery of said single water inlet port, said showerhead comprising:

a plurality of arc-shaped channel walls channel wall disposed between said shower plate and said showerhead body to define an effective channel between said plurality of arc-shaped channel walls and an ineffective channel isolated from said effective channel, said effective channel leading hot water fed from said central water inlet port to each of said periphery of said discharging holes, so as to reduce a pressure-receiving area of said shower plate or said showerhead body to be subjected to a water pressure; and a watertight member disposed between said shower plate and said showerhead body and in watertight contact with said channel wall so as to define said effective channel in cooperation with said channel wall.

4. The showerhead according to claim 3, wherein said watertight member includes: a watertight portion disposed between said showerhead body and said shower plate to water-tightly seal the contact region with said channel wall; and a plurality of discharging nozzles formed on said watertight portion to protrude, respectively, from said discharging holes so as to discharge shower water therethrough.

5. The showerhead according to claim 4, which is designed to be mounted to a ceiling or a wall surface of a bathroom in such a manner that said shower plate is positioned approximately parallel to a floor surface, and said discharging holes or discharging nozzles are positioned approximately perpendicular to the floor surface.

6. The showerhead according to claim 5, wherein said shower plate is formed in an approximately flat shape.

7. The showerhead according to claim 6, which further includes a plurality of fasteners for fastening said shower plate and said showerhead body together, wherein said shower plate has a back surface formed with a plurality of fastener receiving portions arranged at given intervals to receive therein said corresponding fasteners, and each of said fasteners is engaged with a corresponding one of said fastener-receiving portions while penetrating said showerhead body, so as to fasten said shower plate and said showerhead body together.

8. The showerhead according to claim 5, which further includes a plurality of fasteners for fastening said shower plate and said showerhead body together, wherein said shower plate has a back surface formed with a plurality of fastener receiving portions arranged at given intervals to receive therein said corresponding fasteners, and each of said fasteners is engaged with a corresponding one of said fastener-receiving portions while penetrating said showerhead body, so as to fasten said shower plate and said showerhead body together.

9. The showerhead according to claim 3, which is designed to be mounted to a ceiling or a wall surface of a bathroom in such a manner that said shower plate is positioned approximately parallel to a floor surface, and said discharging holes or discharging nozzles are positioned approximately perpendicular to the floor surface.

10. The showerhead according to claim 9, which further includes a plurality of fasteners for fastening said shower plate and said showerhead body together, wherein said shower plate has a back surface formed with a plurality of fastener receiving portions arranged at given intervals to receive therein said corresponding fasteners, and each of said fasteners is engaged with a corresponding one of said fastener-receiving portions while penetrating said showerhead body, so as to fasten said shower plate and said showerhead body together.

11. The showerhead according to claim 9, wherein said shower plate is formed in an approximately flat shape.

12. The showerhead according to claim 11, which further includes a plurality of fasteners for fastening said shower plate and said showerhead body together, wherein said shower plate has a back surface formed with a plurality of fastener-receiving portions arranged at given intervals to receive therein said corresponding fasteners, and each of said fasteners is engaged with a corresponding one of said fastener-receiving portions while penetrating said showerhead body, so as to fasten said shower plate and said showerhead body together.

* * * * *